US005472039A

United States Patent [19]

Schwab

[11] Patent Number: 5,472,039

[45] Date of Patent: Dec. 5, 1995

[54] CASTING SET FOR A DIECASTING MACHINE

[75] Inventor: Wilfried Schwab, Weingarten, Germany

[73] Assignee: Maschinenfabrik Müller-Weingarten AG, Weingarten, Germany

[21] Appl. No.: 231,052

[22] Filed: Apr. 22, 1994

[30] Foreign Application Priority Data

May 19, 1993 [DE] Germany ..... 43 16 927.9

[51] Int. Cl.[6] ..... B22D 17/20

[52] U.S. Cl. ..... 164/149; 164/312

[58] Field of Search ..... 164/149, 312, 164/72, 267

[56] References Cited

U.S. PATENT DOCUMENTS

| | | | |
|---|---|---|---|
| 3,209,416 | 10/1965 | Morton | 164/149 |
| 3,254,377 | 6/1966 | Morton . | |

FOREIGN PATENT DOCUMENTS

| | | | |
|---|---|---|---|
| 0204669 | 12/1986 | European Pat. Off. . | |
| 0394988 | 10/1990 | European Pat. Off. . | |
| 1410361 | 8/1965 | France . | |
| 1489346 | 6/1967 | France . | |
| 1939227 | 8/1965 | Germany . | |
| 2162186 | 6/1972 | Germany . | |
| 3839949 | 3/1990 | Germany . | |
| 44-9643 | 5/1969 | Japan | 164/267 |
| 3-128160 | 5/1991 | Japan | 164/172 |
| 436588 | 11/1967 | Switzerland . | |
| 555984 | 6/1977 | U.S.S.R. | 164/312 |
| 679314 | 8/1979 | U.S.S.R. | 164/149 |
| 869955 | 10/1981 | U.S.S.R. | 164/149 |
| 924494 | 4/1963 | United Kingdom | 164/149 |

OTHER PUBLICATIONS

Machinery, vol. 97, Sep. 28, 1960, Burgess Hill GB Seitan 747–749, "Plunger Lubrication on Cold–Chamber Die Casting Machines", Schimberg.

E. Brunhuber: Praxis der Druckgussfertigung [Practical Diecasting], third edition 1980, pp. 28, 41, 126, 127. Fachverlag Schiele & Schön GmbH, Berlin.

*Primary Examiner*—J. Reed Batten, Jr.

*Attorney, Agent, or Firm*—Spencer, Frank & Schneider

[57] ABSTRACT

A casting chamber has a casting plunger guided therein. In order to supply the casting plunger with lubricant on its outer circumferential surface, the casting chamber has a lubricant channel which runs round in a ring and is supplied via a feed line with lubricant which, after flowing through the lubricant channel, passes into a discharge line for the lubricant.

15 Claims, 2 Drawing Sheets

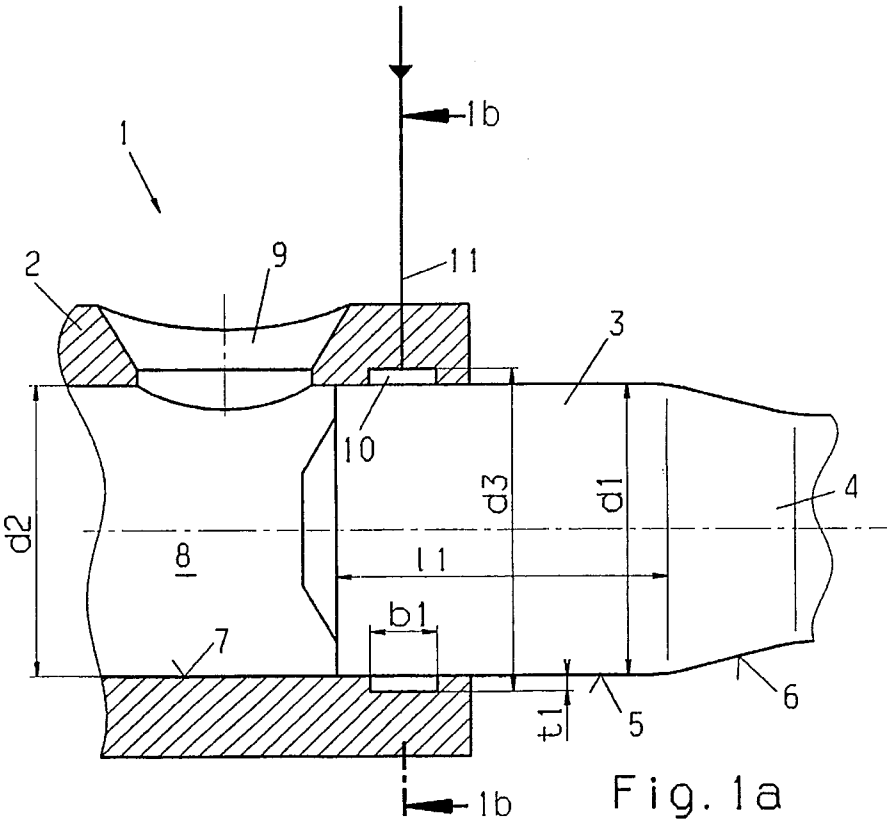
Fig. 1a
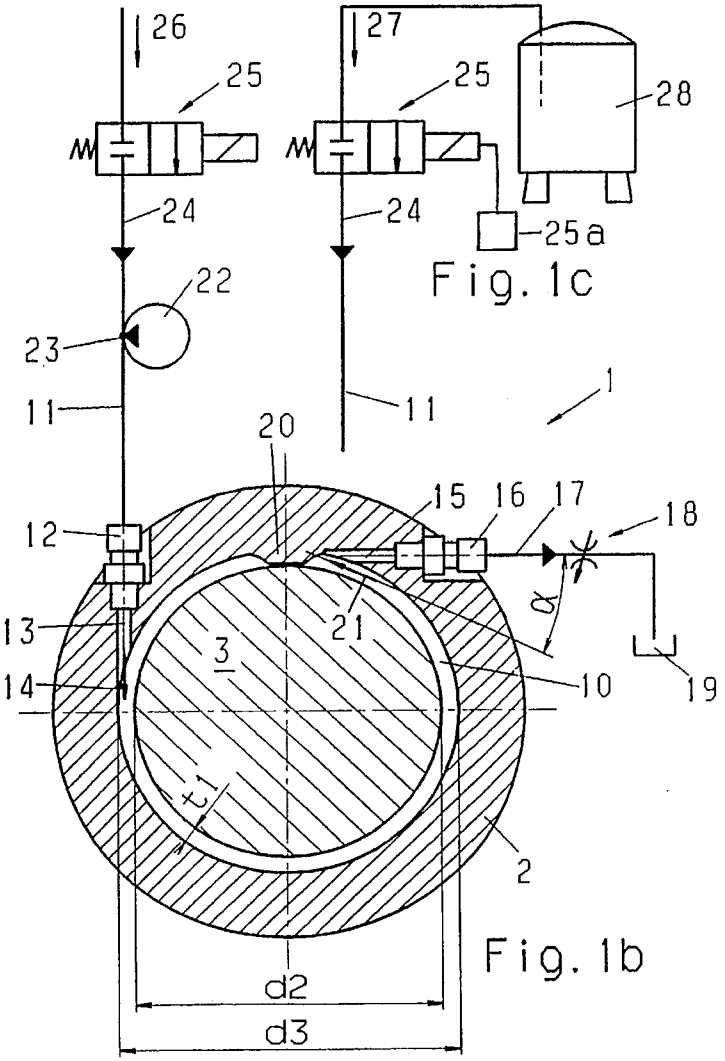
Fig. 1b
Fig. 1c

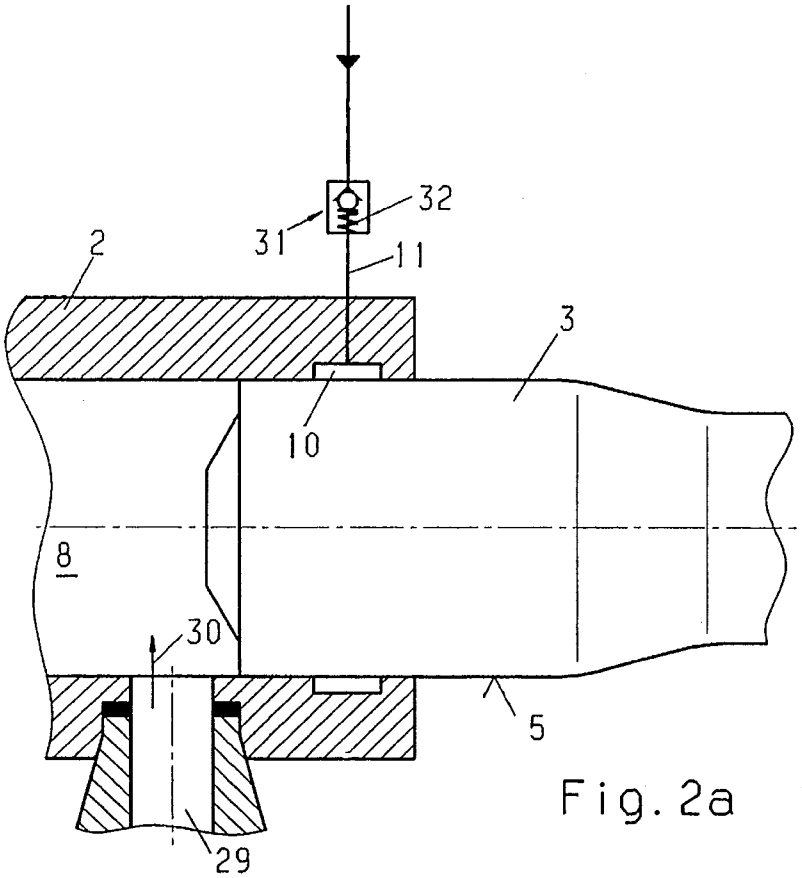
Fig. 2a
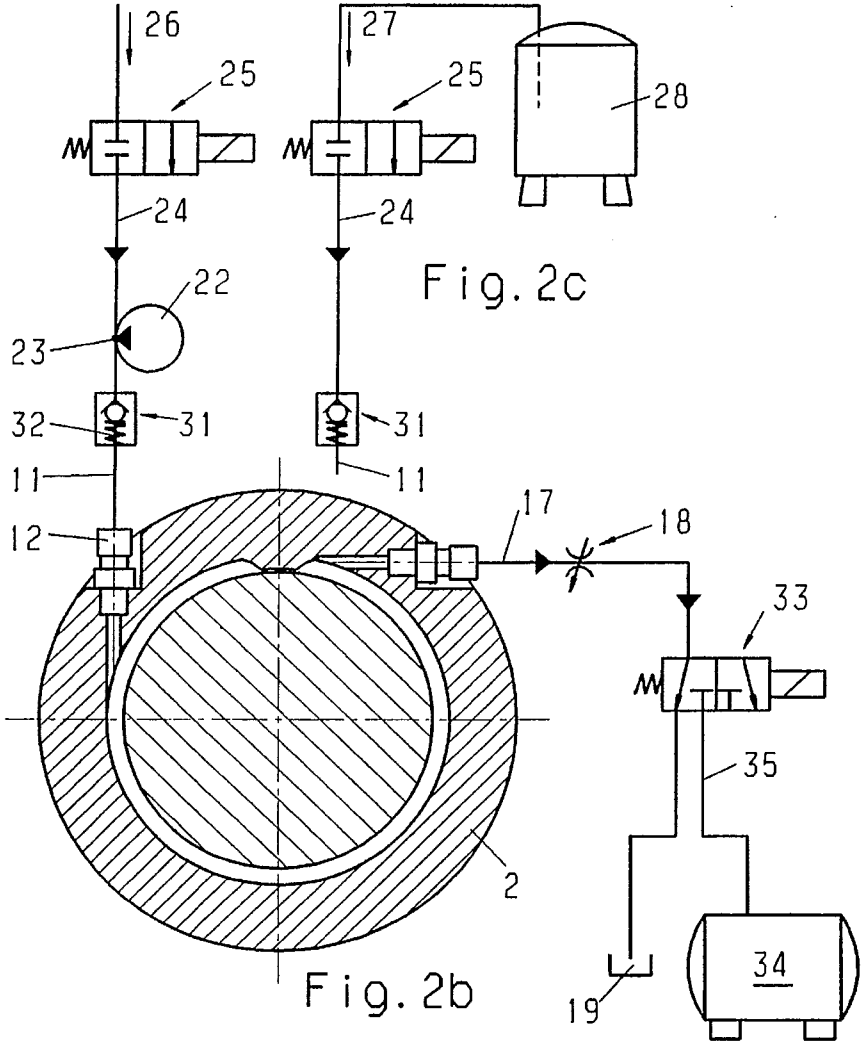
Fig. 2b
Fig. 2c

CASTING SET FOR A DIECASTING MACHINE

BACKGROUND OF THE INVENTION

The invention relates to a casting set for a diecasting machine. The casting set includes a casting chamber, and a casting plunger guided in the casting chamber. The casting plunger has a casting plunger rod operable by a casting drive. A lubricant feed line leading to the circumferential surface of the plunger is provided for the lubrication thereof. The feed line communicates with a lubricant channel formed as an annular groove extending around the casting chamber.

Prior art

A casting set in a casting unit of a diecasting machine, with casting-plunger lubrication to improve the quality of the diecastings, is known from the literature reference Ernst Brunhuber: Praxis der Druckguβfertigung [Practical Diecasting], third edition 1980, page 28 in conjunction with page 41 and pages 126, 127. Here, automatic lubrication of the casting plunger can be achieved by virtue of the fact that leading from a grease pump are lines to two, three or four holes at the casting chamber which open into an annular groove. The lubrication process is triggered by the machine control and metering of the quantity of lubricant is effected in a time-dependent manner. The disadvantage is that the pasty lubricant may go hard after pauses in operation and block the lines. Sprayable lubricants and parting agents are therefore said to be more favorable.

A device for the automatic lubrication of the casting plunger of a cold-chamber diecasting machine is likewise known from the further literature reference Swiss Patent 436,588. In this device, the lubricant is guided via radial holes through the casting-chamber wall to the inner circumferential surface of the casting chamber. Here, the three holes arranged symmetrically on the circumferential surface are closed by means of a spring-assisted spherical closure element. For this purpose, the spherical outer contour of the closure element projects into the cylinder space and is displaced radially outwards by the outer circumferential surface of the casting plunger in order to enable the flow of lubricant to the casting plunger.

This embodiment first of all has the same disadvantages as those described above with reference to the Brunhuber literature reference. By means of such an arrangement, it is furthermore possible for lubricant to emerge only at a number of points on the inner circumferential surface of the casting chamber. Uniform coating of the casting plunger with lubricant is therefore not possible with such an arrangement, which does not have an annular groove.

Fundamentally, the problem with the lubrication of the casting plunger in arrangements of this kind is the impossibility of precise and reproducible metering, particularly as the lubricant sticks due to the effect of the heat of the molten metal and solidifies particularly at inaccessible points, with the result that lubrication of the casting plunger is nonuniform.

German Auslegeschrift 2,162,186 has furthermore disclosed automatic oil spray lubrication for the casting plunger of a cold-chamber diecasting machine in which the plunger rod of the casting set is penetrated by a through hole or a passage through which lubricant is fed to the casting plunger. Here, as described in Brunhuber, page 127, sprayable lubricants are used, these being dispensed onto the inner wall of the casting chamber by means of spray nozzles directly behind the casting plunger. In this way, the sprayable lubricant in this known device in accordance with the German Auslegeschrift is applied directly to the inner wall of the casting chamber by the plunger rod and distributed uniformly over the whole length of the casting chamber by the movement of the casting plunger.

However, such an arrangement for the application of lubricant entails high technical and constructional outlay since separate lines have to be laid through the casting plunger. To carry the lubricant on from the plunger rod to the lubricating assembly, flexible lines are required, and these must accompany the movement of the plunger. However, these hoses are absolutely undesirable particularly in the sector of metal metering. The circumferential surface of the casting plunger itself is furthermore not specifically lubricated. Lubrication is accordingly accomplished by spraying the inner wall of the casting chamber.

A device for the pressurized lubrication of the plungers on diecasting machines with a vertically arranged casting chamber is known from German Utility Model DE-GM 1,939,227. Here, a lubricating block is mounted on the casting chamber in its upper region, this lubricating block forming an annular channel around the casting plunger, and the lubricant is fed to the annular channel via a lubricant feed line by means of a piston-type lubricant pump, a control cam controlling the amount of lubricant during the feed process.

SUMMARY OF THE INVENTION

The object on which the invention is based is to further improve lubrication systems of this kind for the casting plunger of, in particular, a cold-chamber diecasting machine, the intention being, in particular, to achieve as uniform lubrication of the casting plunger and the casting chamber as possible.

The object is furthermore to obtain an as far as possible infinitely variable metered quantity.

This object and others to become apparent as the specification progresses, are accomplished by the invention, according to which, briefly stated, the casting set includes a casting chamber formed of a casting chamber wall having an inner circumferential surface defining a casting chamber interior; an annular groove provided in the casting chamber wall and surrounding the casting chamber interior; a lubricant inlet passing through the casting chamber wall and opening into the annular groove; a feed line connected to the lubricant inlet; a lubricant outlet passing through the casting chamber wall and opening into the annular groove; and a casting plunger received in the casting chamber interior and being slidably movable along the inner circumferential surface of the casting chamber wall. The casting plunger has a position in which a portion of the circumferential plunger surface fully covers the annular groove. Further, an arrangement forces a lubricant through the feed line and the lubricant inlet into the annular groove and out of the lubricant outlet to cause direct impingement of the lubricant on the circumferential plunger surface when the casting plunger fully covers the annular groove.

Advantages of the invention

In comparison with the known devices, the casting set according to the invention as outlined above has the advantage first of all that greatly improved and uniform lubrication of the casting plunger is possible. The basic idea followed here is that the casting plunger can, on the one hand, be wetted all the way round with lubricant and parting agent—referred to below as "lubricant"—in order to obtain uniform lubrication of the casting plunger at all points. By means of the slow forward movement of the casting plunger during the lubricating process, the plunger is lubricated all the way round over its entire length. The lubricating system is configured in such a way that the annular channel surrounding the casting plunger in the diecasting chamber is supplied with lubricant by a lubricant feed line, a further, separate lubricant discharge line being provided into which the lubricant is forced. The feed line and discharge line are arranged in such a way that the lubricant is forced all the way round the casting plunger. This ensures that the entire casting plunger is supplied uniformly with lubricant. The residual lubricant can be collected in a separate container and reused.

As a further development of the invention, the possibility of feeding an infinitely variable metered quantity of the lubricant to the casting plunger is provided. The additional discharge line allows the residual lubricant to be collected and reused.

According to a further provision, the lubricant feed line and the annular channel are supplied with compressed air after the metering of the lubricant. This compressed air then serves as a conveying medium for the lubricant so as to distribute it uniformly on the plunger circumference. The outlet hole ensures that a build-up in the annular channel is avoided and, in addition, excess lubricant metered in can be carried away. This also ensures that no excess lubricant residues remain in the lubricant channel and, in particular, in the casting chamber, with the possibility of baking on and solidification. Also avoided is the overmetering of the lubricant in the next cycle.

The lubricant can be fed in via a lubricant metering pump or directly from a pressure vessel without an additional metering pump. This ensures that no blockages can occur in a lubricant line.

The casting set according to the invention can furthermore be used with advantage both on conventional diecasting machines and with vacuum machines with a vacuum system. The annular channel for feeding in the lubricant can here likewise be used for the production of the vacuum at the casting plunger.

Further details of the invention emerge from the drawings, which are explained in greater detail with further advantages in the following illustrative embodiments.

BRIEF DESCRIPTION OF THE DRAWINGS

FIGS. 1*a* and 1*b* show a first illustrative embodiment of a casting set according to the invention on a conventional horizontal cold-chamber diecasting machine, FIG. 1*a* being a partial elevation of the casting chamber with the casting plunger and FIG. 1*b* being an elevation in accordance with the representation according to section line 1*b*–1*b* in FIG. 1*a* and FIG. 1*c* being a variant embodiment of the lubricant feed and FIGS. 2*a*–2*c* show a corresponding representation of a casting set on a vacuum diecasting machine.

DESCRIPTION OF THE PREFERRED EMBODIMENTS

The basic structure of a cold-chamber diecasting machine is described in German Auslegeschrift 2,162,186 mentioned at the outset. Reference is herewith made to the substantive content of this publication.

In the case of such a cold-chamber diecasting machine, use is made, according to the illustration in FIG. 1*a*, of a casting set 1 which comprises a casting chamber 2 and a casting plunger 3 which is guided in the casting chamber 2 and can be actuated by means of a casting plunger rod 4 by a casting drive (not shown specifically).

The casting plunger 3 has a cylindrical outer circumferential surface 5 of length $l_1$. Adjoining it via a taper 6 is the plunger rod 4.

The outer circumferential surface 5 of the plunger 3, with a diameter $d_1$, is matched to the cylindrical inner circumferential surface 7 of the casting-chamber interior 8 of the casting chamber 2, with the diameter $d_2$. An introduction opening 9 at the rear of the casting chamber 2 serves for the charging of the casting-chamber interior 8 with molten metal.

In order to lubricate the outer circumferential surface 5 of the casting plunger 3, the casting chamber 2 has an encircling cylindrical lubricant groove 10 in its wall section situated behind the introduction opening, this groove having a depth $t_1$ so as to form a ring diameter $d_3$. The groove 10 has an axially measured width $b_1$. Via this lubricant groove or lubricant channel 10, the lubricant and parting agent—referred to in the text which follows as "lubricant"—is fed to the outer circumferential surface 5 of the casting plunger 3.

As can be seen from FIG. 1*b*, a feed line 11 is provided for the purpose of feeding in the lubricant and this feed line is passed into the casting-chamber wall by means of a connection piece 12. As far as possible, the feed channel 13 of the lubricant feed line 11 opens tangentially into the lubricant channel 10, as depicted in FIG. 1*b*. Accordingly, the lubricant is forced tangentially in accordance with the arrow 14 into the annular lubricant channel 10 and guided annularly as far as possible around the entire outer circumferential surface of the casting plunger 3. After having been guided over an angular range of at least 270°, the lubricant reaches an outlet line 15 having a further connection piece 16 in the casting-chamber wall of the casting chamber 2. The connection piece 16 is connected to a lubricant discharge line 17. A variable restrictor 8 in the lubricant discharge line 17 regulates the back pressure for the lubricant to be forced through. A lubricant collecting tank 19 serves to collect the excess lubricant.

The annular lubricant channel 10 can be closed by means of a blocking nose 20 in order to guide the lubricant in the lubricant channel 10 positively to the outlet line 15.

According to the illustration in FIG. 1*b*, the outlet line 15 is not arranged in a direction which tangentially continues the flow of lubricant in the lubricant channel 10 in accordance with the arrow 21, but at an acute angle $\alpha$ thereto. This angular deflection in the region of the blocking nose 20 likewise serves to restrict the flow of lubricant as it emerges from the lubricant channel 10.

The lubricant feed channel 13 can also enter the lubricant channel 10, as far as possible tangentially, directly next to the blocking nose 20, arranged at the top in FIG. 1*b*, in order to ensure that lubricant flows around almost the entire outer circumferential surface 5 of the casting plunger. The outlet line 15 can likewise be passed tangentially, in the direction of flow, out of the lubricant channel 10.

The lubricant itself can be fed to the lubricant channel 10 in various ways. According to the illustration in FIG. 1*b*, this is accomplished via a lubricant pump 22 which is connected directly to the lubricant feed line 11 at point 23. Compressed air (arrow 26) can be added to the system via an on-off valve 25 in a line 24 taken beyond the point 23. The lubricant pump 22 is designed as a metering pump and compressed air can be added to the lubricant to convey the lubricant. This gives rise to a lubricant/air mixture which is fed to the lubricant channel 10 and thus to the casting plunger 3. However, the compressed-air feed 26 can also be used to empty all the lines and lubricant channels in order to remove residues of lubricant. This makes it impossible for lubricant to become encrusted or for residues to over-lubricate the system and lead to gas formation in the molten metal.

It is also possible, in place of the metering pump 22 and the compressed-air feed 26 via the on-off valve 25 (solenoid valve), for a lubricant/air mixture 27 to be taken directly from a pressure vessel 28 and fed to the lubricant feed line 11 in a time-dependent manner via an on-off valve 25, the latter being timed if required. This variant is represented symbolically in FIG. 1*c* next to the variant in FIG. 1*b*. The on-off valve 25 can be operated by means of a timer circuit 25*a* to give a metered supply of the lubricant or lubricant/air mixture to the lubricant channel 10.

Accordingly, a special encircling lubricant channel 10 is placed around the casting plunger 3 as the lubricant chamber, and this is provided with an inlet 13 and an outlet 15 so that the lubricant or a lubricant mixture of air and lubricant is guided around the casting plunger under pressure and the latter is thus wetted with lubricant all the way round. By means of the metering pump 22 or the on-off valve 25, the lubricant mixture can be fed to the casting plunger 3 in a metered manner. By virtue of the fact that a restrictor 18 is installed in the outlet for the lubricant, it is possible to regulate the outgoing air.

During the process of lubricating the casting plunger 3, the latter is moved forwards slowly so that the entire sliding surface or outer circumferential surface 5 of the casting plunger 3 is wetted with lubricant. This process is assisted by the compressed air fed in. The casting plunger is then moved completely through the casting chamber and can thereby distribute the lubricant from the surface of the casting plunger into the casting chamber, i.e. the entire inner wall 7 of the casting-chamber interior 8 is wetted with lubricant over its entire length before the actual working stroke with metal takes place.

After the casting plunger 3 and the inner wall 7 of the casting-chamber interior 8 have been lubricated, the entire annular channel 10 can, after the return of the casting plunger 3 to its starting position in accordance with FIG. 1*a*, be scavenged with compressed air. The residual lubricant is conveyed into the lubricant collecting tank 19 and can be taken from there for reuse.

The illustrative embodiment of the invention according to FIGS. 2*a*–2*c* shows a variant embodiment with a vacuum diecasting machine. Identical parts are denoted by the same reference numerals as in FIGS. 1*a*–1*c*.

In contrast to the illustrative embodiment according to FIG. 1, the casting set according to FIG. 2 has a casting chamber 2, the interior 8 of which is filled with molten metal via a vacuum line 29. For this purpose, the molten-metal feed line 29 is connected up in the bottom region of the casting-chamber wall. A corresponding diecasting machine is described, for example, in DE 41 01 592 Al of the applicant. Reference is herewith made to this description.

To feed the molten metal through the feed line 29, designed as a suction pipe, a negative pressure, referred to as a "vacuum" is applied to the casting chamber. This causes the molten metal to flow from a temperature-maintaining device (not shown specifically) into the casting-chamber interior 8 in accordance with the arrow 30.

To allow this, the arrangement for lubricating the casting plunger 3 via the lubricant channel 10 is provided with an additional nonreturn valve 31 in the lubricant feed line 11. The nonreturn valve is situated between the connection point 23 for the connection of the metering pump 22 and the connection piece 12 leading to the casting chamber 2. The nonreturn valve 31 has a compression spring 32 which closes the valve in such a way that the nonreturn valve 31 cannot be opened by the negative pressure in the lubricant channel 10 built up by the vacuum system. As a result, no lubricant and no unwanted air is sucked out of the line behind the nonreturn valve 31 by the negative pressure.

Conversely, the pressure of the metering pump 22 and the compressed-air feed 26 is able to open the nonreturn valve 31 against the spring force 32 and convey the lubricant or the lubricant mixture into the lubricant channel 10. The same applies, mutatis mutandis, to the variant embodiment according to FIG. 2*c* with the feeding in of the lubricant mixture from the pressure vessel 28.

FIG. 2*b* shows, over and above what is shown in FIG. 1*b*, a multi-way valve 33 in the lubricant discharge line 17 downstream of the restrictor 18. In the position shown, this multi-way valve 33 leads to the lubricant collecting tank 19. In another position of the multi-way valve 33, the channel 10 can be evacuated, i.e. subjected to negative pressure, via a vacuum tank 34 in order to generate a vacuum or negative pressure at the circumferential surface 5 of the casting plunger. The lubricant channel 10 is thus used not only to lubricate the casting plunger 3 but also to produce a negative pressure at the casting plunger 5, i.e. the channel 10 has a double use. The negative pressure set up at the casting plunger prevents the penetration of atmospheric air into the casting chamber. This vacuum connection via the vacuum tank 34 is effected via the connection line 35 leading to the multi-way valve 33.

The invention is not restricted to the illustrative embodiment described and illustrated. On the contrary, it includes all further developments and improvements within the scope of the inventive concept made by a person skilled in the art.

I claim:

1. A casting set for a diecasting machine; said casting set comprising (a) a casting chamber formed of a casting chamber wall having an inner circumferential surface defining a casting chamber interior;

(b) an annular groove provided in said casting chamber wall and being open at said inner circumferential surface; said annular groove surrounding said casting chamber interior;

(c) a lubricant inlet passing through said casting chamber wall and opening into said annular groove;

(d) a feed line connected to said lubricant inlet;

(e) a lubricant outlet passing through said casting chamber wall and opening into said annular groove;

(f) a casting plunger received in said casting chamber interior and being slidably movable along said inner circumferential surface of said casting chamber wall; said casting plunger having a circumferential plunger surface; said casting plunger having a position in which a portion of said circumferential plunger surface fully covers said annular groove; and (g) means for forcing a lubricant through said feed line and said lubricant inlet into said annular groove and out of said lubricant outlet to cause direct impingement of the lubricant on said portion of said circumferential plunger surface in said position of said casting plunger.

2. The casting set as defined in claim 1, wherein said annular groove has a rectangular cross section and is located in an end region of said casting chamber.

3. The casting set as defined in claim 1, wherein said lubricant inlet opens tangentially into said annular groove.

4. The casting set as defined in claim 1, further comprising a blocking nose projecting from said casting chamber wall into said annular groove for providing a discontinuity therein.

5. The casting set as defined in claim 4, wherein said blocking nose has an outer end face extending to the plunger surface when said casting plunger is in said position.

6. The casting set as defined in claim 4, wherein said blocking nose is situated upstream of a location where said lubricant inlet opens into said annular groove and downstream of a location where said lubricant outlet opens into said annular groove, as viewed in a direction of lubricant flow in said annular groove from said lubricant inlet to said lubricant outlet.

7. The casting set as defined in claim 1, wherein said lubricant outlet defines an acute angle with the annular groove as viewed in a direction of lubricant flow in said annular groove toward said lubricant outlet.

8. The casting set as defined in claim 1, wherein said means for forcing comprises a metering pump connected directly to said feed line.

9. The casting set as defined in claim 8, further comprising a compressed-air line connected to said feed line and an on-off valve contained in said compressed-air line.

10. The casting set as defined in claim 1, wherein said means for forcing comprises a pressure vessel containing an air/lubricant mixture connected directly to said feed line and an on-off valve contained in said feed line.

11. The casting set as defined in claim 10, further comprising a timer circuit connected to said on-off valve.

12. The casting set as defined in claim 1, further comprising a nonreturn valve contained in said feed line for preventing backflow of lubricant in said feed line from said annular groove; said nonreturn valve being biased closed with a force that resists a vacuum in said casting chamber interior for preventing lubricant from being drawn through said lubricant inlet into said annular groove by the vacuum.

13. The casting set as defined in claim 1, further comprising a lubricant discharge line connected to said lubricant outlet and a variable restrictor contained in said lubricant discharge line.

14. The casting set as defined in claim 1, further comprising a lubricant discharge line connected to said lubricant outlet and a lubricant collecting tank connected to said lubricant discharge line.

15. The casting set as defined in claim 1, further comprising (h) a lubricant discharge line connected to said lubricant outlet;

(i) a vacuum tank connected to said lubricant discharge line; and (j) a multi-way valve contained in said lubricant discharge line for controlling admission of a negative pressure to said casting plunger.

* * * * *